US006334729B1

(12) United States Patent
Ohba

(10) Patent No.: US 6,334,729 B1
(45) Date of Patent: Jan. 1, 2002

(54) COSMETIC CONTAINER AND CARTRIDGE FOR COSMETIC CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/701,010

(22) PCT Filed: Mar. 16, 2000

(86) PCT No.: PCT/JP00/01596

§ 371 Date: Nov. 22, 2000

§ 102(e) Date: Nov. 22, 2000

(87) PCT Pub. No.: WO00/59336

PCT Pub. Date: Oct. 12, 2000

(30) Foreign Application Priority Data

Mar. 31, 1999 (JP) ..... 11-093628
Mar. 31, 1999 (JP) ..... 11-093629

(51) Int. Cl.[7] ..... A45D 40/04
(52) U.S. Cl. ..... 401/68; 401/75; 401/79
(58) Field of Search ..... 401/62, 68, 70, 401/75, 76, 79, 86, 87, 172, 174

(56) References Cited

U.S. PATENT DOCUMENTS 5,879,093 A * 3/1999 Ohba et al. ..... 401/68
5,884,638 A * 3/1999 Ohba ..... 132/318

FOREIGN PATENT DOCUMENTS

| | | |
|---|---|---|
| DE | 43 40 067 | 5/1994 |
| JP | 60 48706 | 3/1985 |
| JP | 3-50814 | 10/1991 |
| JP | 4 30961 | 7/1992 |
| JP | 6-21390 | 6/1994 |
| JP | 6-209822 | 8/1994 |
| JP | 8-228836 | 9/1996 |
| JP | 9-224741 | 9/1997 |
| JP | 10-80319 | 3/1998 |

* cited by examiner

*Primary Examiner*—David J. Walczak
*Assistant Examiner*—Peter deVore
(74) *Attorney, Agent, or Firm*—Rabin & Berdo

(57) ABSTRACT

At least a part of a cylindrical body (20) is rotatably and unslidably housed in a front cylinder (10). A beam (30) for retaining a stick type cosmetic material (4) on the upper end side is made unrotatable and slidable to the front cylinder (10) by a sliding mechanism and made feedable by a rotation together with the cylindrical body (20) by a feeding mechanism. The beam (30) is always urged downward by a return spring (6). It is arranged such that a lower end part of the cylindrical body (20) is at the same level as that of a lower end part of the front cylinder (10) and a synchronous engagement section (26) formed on an inner circumferential surface of a lower end part of the cylindrical body (20) is synchronously engaged with a synchronous engagement shaft 43 provided at a bottom (42) of a container body (2). An O-ring (5) is installed between the front cylinder (10) and the container body (2).

17 Claims, 12 Drawing Sheets

COSMETIC CONTAINER AND CARTRIDGE FOR COSMETIC CONTAINER

TECHNICAL FIELD

The present invention relates to a cartridge of make-up container and make-up material container.

BACKGROUND ART

With regard to a cosmetic container which feeds out a stick type cosmetic material housed in a cartridge, such as eyeliner, eyebrow pencil, eye shadow, or lipstick, through an opening provided at an upper end of the cartridge due to rotations of the cartridge and a container body, there are proposals, for example, in Japanese Patent Laid-Open Publication No. Sho 60-48706, Japanese Utility Model Publication No. Hei 4-30961, and the like.

Further, with regard to a cosmetic container, among the cosmetic containers described above, in which if a cartridge is removed from a container body, a stick type cosmetic material fed out of the cartridge will automatically be housed in the cartridge, there are proposals, for example, in Japanese Utility Model Publication No. Hei 3-50814 and Japanese Utility Model Publication No. Hei 6-21390 which have been applied by the applicant of the present invention.

In a cosmetic container disclosed in Japanese Utility Model Publication No. Hei 3-50814 among them, a feeding mechanism is installed at a container body. As a cartridge fitted to the container body rotates, the feeding mechanism actuates and feeds out an extrusion beam which is installed at the container body in such a manner that the extrusion beam can slide in an axial direction. Pressed out by the extrusion beam, a stick type cosmetic material in the cartridge is fed out. Further, a return spring is provided at the extrusion beam and a support member for the stick type cosmetic material, respectively, and when the cartridge is removed from the container body, these return springs automatically return.

Further, in a cosmetic container disclosed in Japanese Utility Model Publication No. Hei 6-21390, a feeding mechanism is provided on the side of a cartridge, and a shaft is installed at the container body in a standing position. The shaft is a guide shaft for a push rod which is fed out by the feeding mechanism and the shaft is engaged with the push rod in such a manner that the shaft cannot rotate, but can slide in an axial direction. Thus, when the container body and the cartridge rotate, the push rod rotates to the cartridge, the push rod is fed out by the feeding mechanism, and a stick type cosmetic material retained at an upper end of the push rod is fed out. Further, a return spring for pushing back the push rod to an initial position is provided on the cartridge side, and it is arranged such that when the cartridge is removed from the container body, the stick type cosmetic material is drawn back to an initial position.

However, in the cosmetic container disclosed in Japanese Utility Model Publication No. Hei 3-50814 described above, when the cartridge is removed from the container body, the extrusion beam on the container body side and the support member for the stick type cosmetic material on the cartridge side are returned, respectively. Thus, separate return springs are required and a cost of the entire cosmetic container increases. Further, overall length of the cosmetic container has to be approximately the sum total of the length of the cartridge and the length of the extrusion beam, whereby the cosmetic container becomes huge.

On the other hand, the cosmetic container disclosed in Japanese Utility Model Publication No. Hei 6-21390 has the advantages that only a single return spring is required and the overall length of the cosmetic container can relatively be short. However, in the cosmetic container, the shaft having a length at least equivalent to a stroke of the push rod has to be installed at the container body in a standing position, whereby constitution of the container body becomes complicated. Further, it is necessary that a hole in which the shaft is engaged is formed at the push rod, whereby a certain thickness is required. Therefore, the cosmetic container has to be thick by a portion equivalent to a thickness of the push rod, whereby it is difficult to be applicable to a cosmetic material having a thin diameter. Further, the push rod and the container body synchronously rotate during operation of the feeding mechanism. Therefore, in order to prevent the stick type cosmetic material fed out from rotating to the front cylinder of the cartridge, it has to be constituted such that the support member for the stick type cosmetic material is separated from the push rod, whereby constitution of the cartridge becomes complicated.

DISCLOSURE OF THE INVENTION

An object of the present invention is to provide a cartridge for a cosmetic container or the cosmetic container in which a stick type cosmetic material automatically returns by removing the cartridge, constitution of a container body can be simplified, it is possible to apply to a various kinds of stick type cosmetic materials, and operation of automatic return is stabilized.

In order to achieve the object described above, the present invention provides a cartridge for a cosmetic container or the container having the following constitution.

In a cartridge for a cosmetic container which is installed at a container body in such a manner that the cartridge can easily be attached and removed, houses and retains a stick type cosmetic material therein, and moves the stick type cosmetic material forward and backward through an opening provided at an upper end by a rotation together with the container body, there are provided a front cylinder having the upper end opening and a cylindrical body at least a part of which is housed in the front cylinder in such a manner that the cylindrical body can rotate, but cannot slide. A cartridge body is composed of the front cylinder and the cylindrical body. A beam is housed in the cartridge body and a cosmetic material retaining section for retaining the stick type cosmetic material is formed on the side of an upper end of the beam. There are provided a sliding mechanism for retaining the beam in the front cylinder in such a manner that the beam cannot rotate, but can slide, a feeding mechanism for feeding out the beam in an axial direction by relative rotations of the beam and the cylindrical body, and a spring for always urging the beam backward. A synchronous engagement means which is synchronously engaged with the container body is installed at a lower end part of the cylindrical body.

The stick type cosmetic material does not rotate to the front cylinder and therefore the stick type cosmetic material makes a stroke in a smooth and stable manner. Thus, for example, even in the case that the stick type cosmetic material automatically returns, it is hard for the stick type cosmetic material to break.

Further, since the container body is connected with the cylindrical body via the synchronous engagement means, when the cartridge is drawn out of the container body, the stick type cosmetic material automatically returns. Therefore, feed-down operation can be facilitated and also constitution of the container body can be simplified with a function to prevent the stick type cosmetic material from breaking being held.

Further, the beam can have a thin diameter because it is not necessary to provide a hole to be used for connecting the beam with the container body, whereby a diameter of the cartridge body can sufficiently be small. Therefore, it is possible to easily constitute the cosmetic container which is applicable to a stick type cosmetic material having a thin diameter.

When the cylindrical body is entirely housed in the front cylinder, an outer frame of the cartridge is composed of the front cylinder which is a single member. Thus, when the cartridge is removed from the container body, if the cartridge is kept to be a single unit, a user cannot rotate the front cylinder and the cylindrical body while holding them. In other words, unless the cartridge is installed at the container body, operation of feeding out the stick type cosmetic material from the cartridge will not be carried out. Thus, it is possible to prevent the stick type cosmetic material from breaking or being damaged which may occur resulting from feeding it out by an operational error at the time of removing the cartridge from the container body.

It is arranged such that a lower end part of the cylindrical body and a lower end part of the front cylinder are of almost same height, the synchronous engagement means is composed of spline grooves formed on an inner circumferential surface on the lower end side of the cylindrical body, and a synchronous engagement shaft formed at a bottom of the container body is engaged with the spline grooves by spline connection. Thus, the cylindrical body and the container body are synchronously engaged, whereby it will be sufficient if the container body is merely provided with a small synchronous engagement shaft. Therefore, constitution of the container body can extremely be simplified, for example, it is possible to easily manufacture the container body as a single member by die forming, whereby the manufacturing costs can remarkably be reduced. Further, since it is also possible to easily set the length of the container body, the cosmetic container having a length which is easy to handle can easily be constituted.

The feeding mechanism described above is composed of a spiral section formed at an outer circumference of the beam and a spiral groove which is formed on an inner circumferential surface of the cylindrical body and with which a part of the spiral section is spirally engaged.

It is arranged such that a non-projection section in which the spiral section does not exist is formed on the base end side of the beam and a stroke limit of the beam is defined when the beam makes a stroke to a position where the non-projection section faces the spiral groove. Thus, when a guide projection escapes from the spiral groove, the stroke of the beam reaches an uppermost limit where the stick type cosmetic material cannot be fed out. Further, since the beam is urged downward by the spring, if the container body and the cartridge which has reached the uppermost limit are raced, a noise will arise resulting from the contact of a spiral groove end section of the beam and the guide projection of a guide rod, thereby notifying a user that the stroke has reached the uppermost limit. Therefore, the cosmetic container will never be handled in such a manner that a strain is put on mechanisms in the cartridge (for example, operation of compressing the spring beyond a compression limit), whereby it is possible to prevent the mechanisms in the cartridge from being damaged.

The sliding mechanism is composed of an engagement section formed at an outer circumference of the beam and a sliding section which is formed at an inner circumference of the front cylinder and engaged with the engagement section.

The engagement section of the sliding mechanism is a plurality of claws which retain the stick type cosmetic material in such a manner that the claws surround the stick type cosmetic material. Also, the stick type cosmetic material is supported between these claws by an inner circumferential surface of the front cylinder from the side. Thus, the stick type cosmetic material can securely be retained with a diameter of the cartridge being minimum, whereby it is possible to prevent the stick type cosmetic material from breaking at the time of the stroke even though the stick type cosmetic material has a thin diameter.

On the other hand, if a small diameter section is formed at the front cylinder so that the small diameter section is positioned right above the cylindrical body and also the sliding section is formed on an inner circumferential surface of the small diameter section, it will not be necessary to form the sliding section on an inner circumferential section on the upper part side of the front cylinder. Thus, it is also possible to adopt a type which is formed by filling a liquid cosmetic raw material as a stick type cosmetic material through an opening provided at an upper end of the front cylinder. Further, since the small diameter section is provided above the cylindrical body in this case, it is hard for the cosmetic raw material to flow to the cylindrical body side, whereby productive efficiency of the cosmetic container can be enhanced. Further, unlike the case that the sliding mechanism is constituted by unrotatably engaging the inner circumferential surface on the upper part side of the front cylinder and the cosmetic material retaining section which are not circular, a cross section of the inner circumference on the upper part side of the front cylinder can be round.

Further, the spiral section is a plurality of engagement projections arranged below the engagement section and on a straight line which extends in an axial direction and also the spiral section can be an engagement section which is engaged with the sliding section formed on the upper part side of the front cylinder when fed out to the upper part side of the front cylinder. In this case, since the engagement projections are engaged with the sliding section of the sliding mechanism one after another when the beam makes a stroke, the engagement projections operate as a component of the feeding mechanism which is spirally engaged with the spiral groove and also operate as the engagement section of the sliding mechanism. Therefore, the stroke of the beam can be more stable and also the cartridge can bear a load in a direction of torsion. Further, the diameter of the cartridge can extremely be thin.

The spring is a coil spring wound around an outer circumference of the beam, an upper end of the coil spring is in contact with a downward step section formed at the cylindrical body, and a lower end of the coil spring is in contact with an upward step section provided at the beam. Thus, structure of the spring installed can be simplified and also installation work of the spring can easily be done, whereby manufacturing costs of the cosmetic container can be reduced.

An O-ring is provided between an outer circumference of the front cylinder and an inner circumference of the container body, and it is arranged such that frictional force which arises due to the O-ring is greater than resiliency of the spring to cause a reverse rotation of the front cylinder and the container body. Thus, a mechanism for maintaining a rotary position of the cartridge against spring force can simply be constituted at a low cost. Further, the frictional force of the O-ring gives appropriate weight (resistance) to rotating operation of the cartridge, thereby giving an operator the sensation of solidity in the rotating operation. Further, due to the O-ring, it is possible to restrain the cartridge from wobbling.

Further, there are provided the cartridge in which an entire body of the cylindrical body is housed in the front cylinder and the container body in which the cartridge is housed in such a manner that the cartridge can easily be attached or detached. When the cartridge is housed in the container body, the front cylinder is rotatable to the container body and the feeding mechanism is unrotatably connected with the container body via the synchronous engagement section.

There is provided a cylindrical body which is rotatably installed on the base end side of the front cylinder. Thus, even when the cartridge is a single unit, an operator can feed out the stick type cosmetic material by rotating the cylindrical body and the front cylinder and can confirm the type (color) or the residual amount of the stick type cosmetic material. Consequently, even in the case that a plurality of cartridges are prepared for a single container body, it is not necessary to install the cartridges at the container body in order to confirm the stick type cosmetic material, whereby it is convenient. Further, after the confirmation, the stick type cosmetic material is automatically returned into the cartridge due to operation of an urging means. Thus, the stick type cosmetic material will never be left as it is fed out to the outside of the cartridge, thereby decreasing a fear that the stick type cosmetic material may break or become dirty.

The engagement section of the sliding mechanism is formed at an outer circumference of the cosmetic material retaining section.

BEST MODE FOR CARRYING OUT THE INVENTION

Embodiments of the present invention will subsequently be described with reference to the accompanying drawings.

Figure 1:
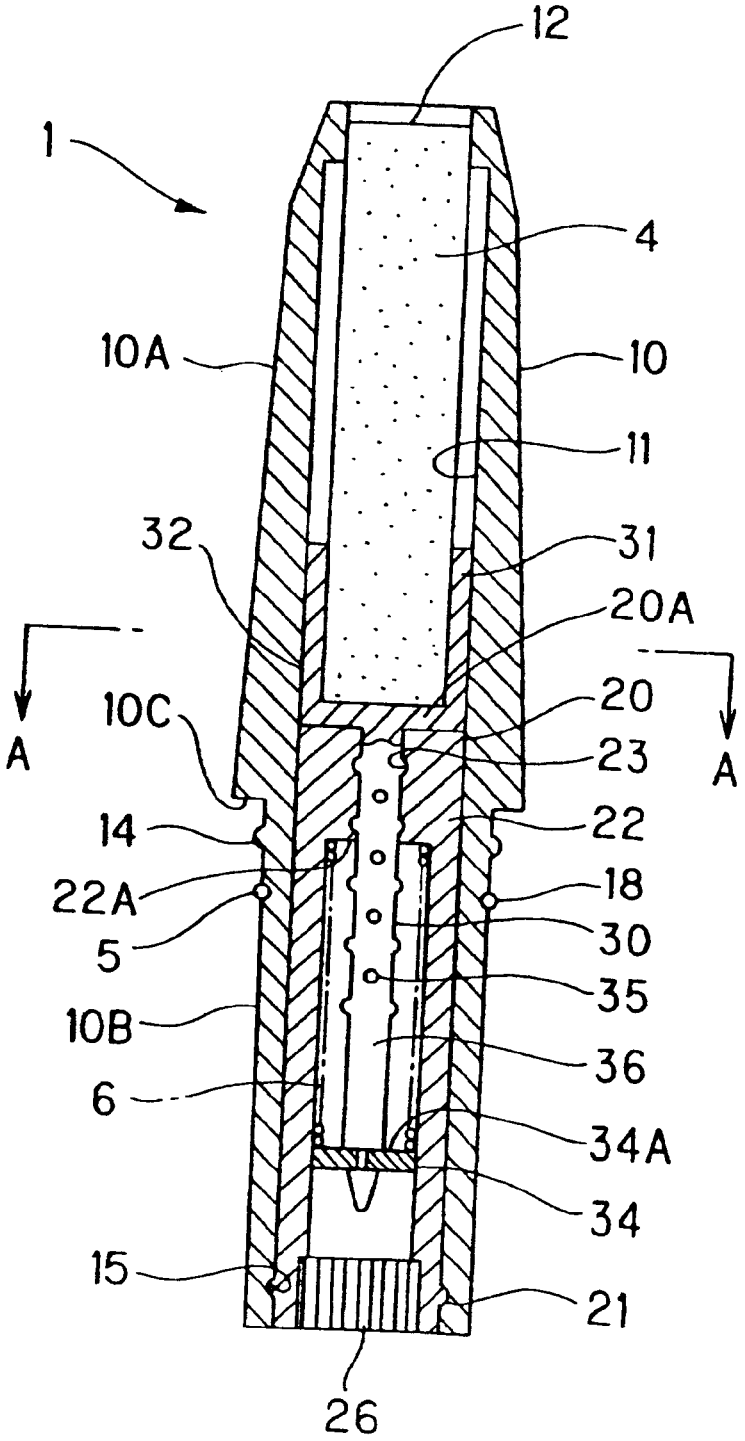
FIG. 1 is a sectional view showing a cartridge according to a first embodiment of the present invention.
Figure 2:
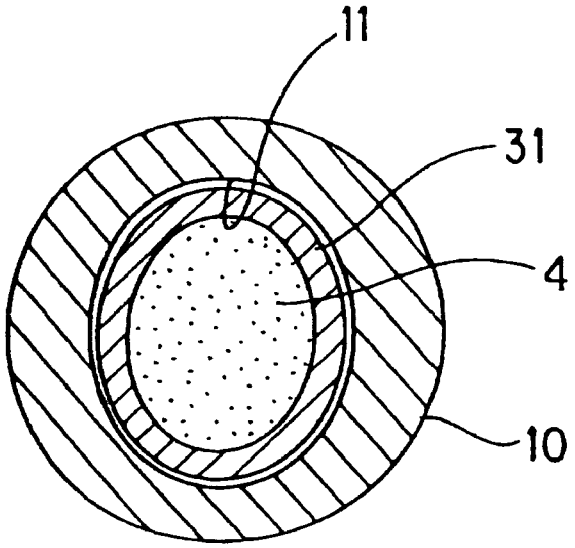
FIG. 2 is a sectional view taken along line A—A of FIG. 1 similarly.
Figure 3:
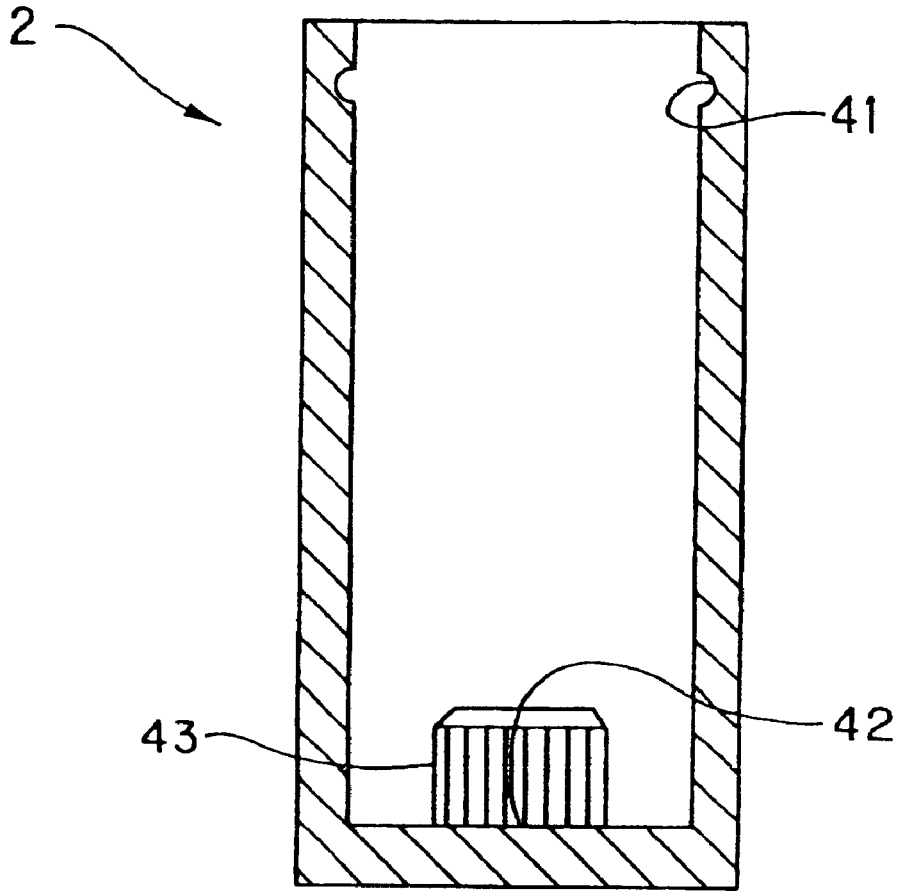
FIG. 3 is a sectional view showing a container body similarly.

FIG. 1 shows a cartridge 1 for a cosmetic container according to a first embodiment of the present invention. Further, FIG. 2 is a sectional view taken along line A—A of FIG. 1 and FIG. 3 shows a container body 2 in which the cartridge 1 of FIG. 1 is installed in such a manner that the cartridge 1 can easily be attached or detached, respectively. The cosmetic container is composed of the cartridge 1 of FIG. 1 and the container body 2 of FIG. 3.

The cartridge 1 in which a stick type cosmetic material 4 is housed in such a manner that the stick type cosmetic material 4 can be fed out is composed of a front cylinder 10, a cylindrical body 20, a beam (push rod) 30, and a return spring 6.

The front cylinder 10 is a cylindrical member which constitutes an outer frame of the cartridge 1, and it is composed of an exposed section 10A which is closer to the upper end than a difference in level 10C is and a storage section 10B which is closer to the lower end than the difference in level 10C is. When the cartridge 1 is fitted to the container body 2, the exposed section 10A is exposed at the outside of the container body 2 and the storage section 10B is housed in the container body 2.

The inside of the front cylinder 10 on the side of the exposed section 10A is a cosmetic material storage hole 11 in which the stick type cosmetic material 4 is stored. The cosmetic material storage hole 11 has a cross section in the form of an ellipse, and a cosmetic material retaining section 31 of the beam 30 which is not circular is unrotatably fitted therein as will be described later. Further, the stick type cosmetic material 4 which is retained by the cosmetic material retaining section 31 and stored in the cosmetic material storage hole 11 is fed out through an opening 12 provided at an upper end of the front cylinder 10 in such a manner that the stick type cosmetic material can freely go in and out.

The storage section 10B of the front cylinder 10 has an outer diameter almost same as an inner diameter of the container body 2. Further, an annular fitting convex section 14 is formed at an outer circumference of the storage section 10B. When the storage section 10B is housed in the container body 2, the fitting convex section 14 fits in an annular fitting concave section 41 formed on an inner circumferential surface of the container body 2. Thus, the front cylinder 10 and the container body 2 are positioned so that they cannot move (come out) in an axial direction and can easily rotate in a rotary direction.

A cross section of the inside of the front cylinder 10 on the side of the storage section 10B is circular, and the cylindrical body 20 having an outer diameter almost same as an inner diameter of the front cylinder 10 is housed therein. The front cylinder 10 and the cylindrical body 20 constitute a cartridge body.

In this case, a fitting convex section 21 formed on an outer circumferential surface of the cylindrical body 20 fits in an fitting concave section 15 formed on an inner circumferential surface of the front cylinder 10. Thus, the cylindrical body 20 is positioned so that it cannot move (come out) in an axial direction of the front cylinder 10 and can freely rotate in a rotary direction of the front cylinder 10.

Further, a lower end of the front cylinder 10 and a lower end of the cylindrical body 20 are aligned at almost same height, whereby the cylindrical body 20 is entirely housed in the front cylinder 10.

Further, on an inner circumferential surface of a lower end part of the cylindrical body 20, a synchronous engagement section 26 composed of a plurality of vertical grooves (spline grooves) extending in an axial direction is formed. On the other hand, a synchronous engagement shaft 43 is fixed at a bottom 42 of the container body 2, and a plurality of line sections (spline projections) extending in an axial direction are formed at an outer circumference of the synchronous engagement shaft 43. Thus, when the cartridge 1 is housed in the container body 2, the synchronous engagement section 26 is unrotatably engaged (spline connection)

with the synchronous engagement shaft 43 and the cylindrical body 20 and the container body 2 are unrotatably connected. Therefore, when the cartridge 1 is fitted to the container body 2, if the front cylinder 10 is rotated to the container body 2, the front cylinder 10 and the cylindrical body will be rotated.

Further, a spiral cylinder section 22 having a small inside diameter occupies a prescribed length of the upper end side of the cylindrical body 20. A spiral groove 23 is cut on an inner circumferential surface of the spiral cylinder section 22. A plurality of engagement projections 35 (spiral section) provided at an outer circumference of the beam 30 which will be described later are spirally engaged with the spiral groove 23.

The beam 30 is coaxially housed in the cartridge body (the front cylinder 10 and the cylindrical body 20). The cosmetic material retaining section 31 is provided on the side of an upper end (on the side of the opening 12) of the beam 30. The cosmetic material retaining section 31 is a cup having an ellipse cross section which can just fit in the cosmetic material storage hole 11 being not circular, and a lower end part of the stick type cosmetic material 4 is retained in the cup.

Incidentally, a sliding mechanism is not restricted to the unrotatable engagement of the cosmetic material retaining section 31 and the cosmetic material storage hole 11 which are elliptic. For example, unrotatable engagement of polygonal components is also preferable. Further, the sliding mechanism may be constituted by engagement of sliding projections (engagement section) formed at the beam 30 (for example, an outer circumferential surface of the cosmetic material retaining section 31) with slide grooves (sliding section) formed on an inner circumferential surface of the front cylinder 10 (for example, an inner circumferential surface of the cosmetic material storage hole 11). Various types of embodiments can be applied (for example, refer to a second embodiment which will be described later).

Further, the beam 30 can make a stroke in an axial direction in the cartridge body. Thus, the stick type cosmetic material 4 coaxially retained by the cosmetic material retaining section 31 advances or retreats through the opening 12 of the front cylinder 10 with the progress of the stroke of the beam 30.

The plurality of engagement projections 35 are formed at an outer circumference of the beam 30 in a straight line which extends in an axial direction. The area extends from right below the cosmetic material retaining section 31 over a length equivalent to the stroke of the beam 30. A group of these engagement projections 35 are arranged (arranged along a spiral track) in a manner suitable for the spiral groove 23 of the spiral cylinder section 22 described above, and a part of the engagement projections 35 is spirally engaged with the spiral groove 23 according to a stroke position of the beam 30.

The spiral groove 23 and the plurality of engagement projections 35 constitute the feeding mechanism of the cosmetic container. More specifically, when the front cylinder 10 (beam 30) and the container body 2 (cylindrical body 20) are rotated, the plurality of engagement projections 35 are spirally engaged with the spiral groove one after another and the beam 30 is fed out to the cylindrical body 20.

Incidentally, the lowermost limit of a stroke of the beam 30 is a stroke position where a cosmetic material retaining section base section 32 comes into contact with a cylindrical body upper end 20A.

In this embodiment, it is arranged such that the beam 30 is fed out by spirally disposing the plurality of engagement projections 35 at the beam 30 and spirally engaging them with the spiral groove 23 on after another. However, needles to say, those to be spirally engaged with the spiral groove 23 are not restricted to the engagement projections 35. For example, ordinary male screws which are spirally engaged with the spiral groove 23 may also be used.

Figure 4:
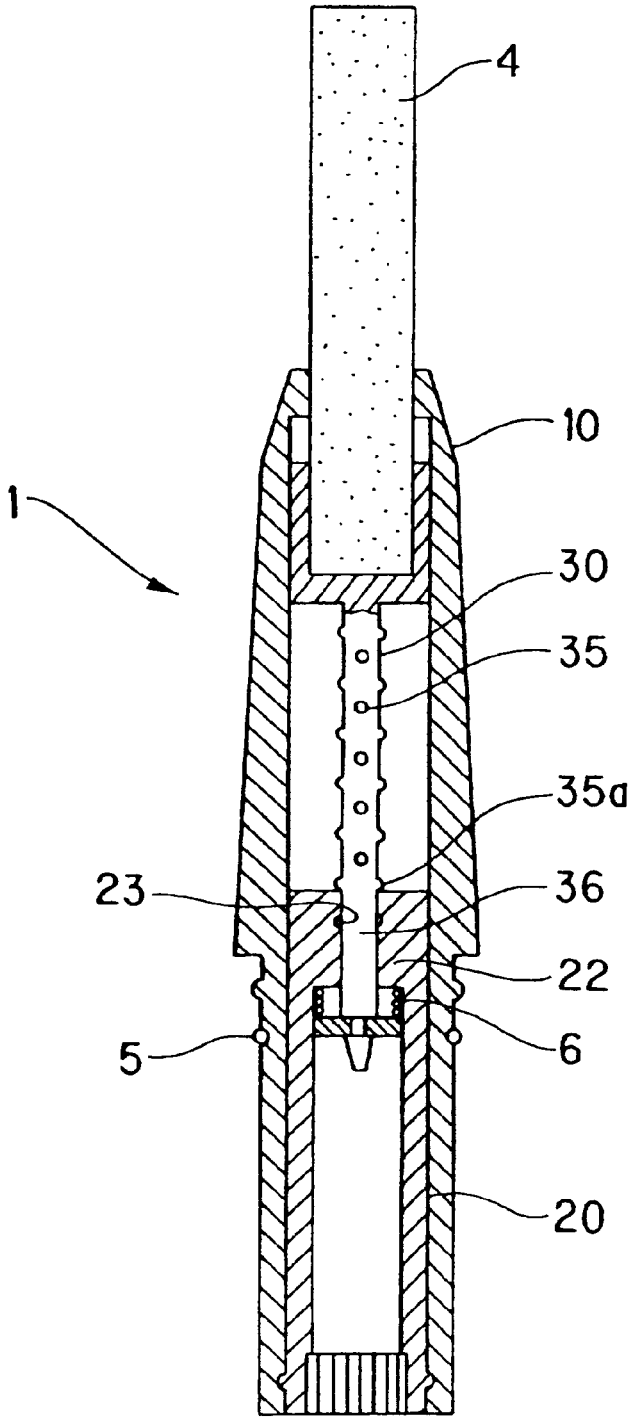
FIG. 4 is a sectional view showing a cartridge which has reached a feeding uppermost limit similarly.

Further, a non-projection section 36 at which no engagement projections 35 are formed is provided below the files of the engagement projections 35 of the beam 30. As shown in FIG. 4, when the beam 30 makes a stroke and the non-projection section 36 rises to a position where the non-projection section 36 faces the spiral cylinder section 22, all the engagement projections 35 escape from the spiral groove 23. Thus, even though the front cylinder 10 is rotated, the feeding mechanism does not function and the beam 30 does not make any stroke. In other words, the stroke position becomes an uppermost limit of the stroke of the beam 30. Incidentally, the uppermost limit of the stroke is set so that the return spring 6 which will be described later does not shrink beyond the shrinkage limit.

The return spring 6 which is a coiled compression spring is provided at an outer circumference of the beam 30. An upper end of the return spring 6 comes into contact with a lower end surface 22A (downward step section) of the spiral cylinder section 22, whereas its lower end comes into contact with a top surface 34A (upward step section) of a fastening member 34 of the beam 30. Thus, the beam 30 is always urged in an axial and downward direction by the return spring 6. Incidentally, the fastening member 34 is a spring seat member which is installed at an outer circumference of the beam 30 near its lower end (below the non-projection section 36).

A ring groove 18 is formed at a prescribed position of an outer circumferential surface of the storage section 10B of the front cylinder 10. An O-ring 5 is fitted into the ring groove 18 as a means for giving resistance.

It is set so that frictional power (torque resulting from the frictional power) which arises between the O-ring 5 and the container body 2 is always greater than resiliency (reverse torque resulting from the resiliency) of the return spring 6 which will cause reverse rotations of the front cylinder 10 and the cylindrical body 20. Thus, it never happens that when the cartridge 1 and the container body 2 are rotated, the cartridge 1 and the container body 2 make reverse rotations due to the return spring 6 which pushes back the beam 30 downward. Therefore, the rotary position is maintained.

On the other hand, if the cartridge 1 is removed from the container body 2 in such a state that the cartridge 1 is rotated (in a state that the stick type cosmetic material 4 is fed out), there will be no frictional resistance of the O-ring 5. Thus, the beam 30 will be brought back to the lowermost limit of a stroke due to spring tension of the return spring 6 and the stick type cosmetic material 4 will automatically be housed in the cartridge.

Further, the frictional resistance of the O-ring 5 gives proper weight (resistance) to the rotations of the cartridge 1, thereby giving a user of the cosmetic container the sensation of solidity in the operation. Further, due to the O-ring 5, it is possible to restrain the cartridge 1 from wobbling in the container body 2.

Next, a procedure of assembling the cosmetic container will be described.

In assembling, first the beam 30 is inserted into an opening on the upper end side of the cylindrical body 20 from the lower end side in a state that the fastening member 34 has not been installed. By spirally engaging the engagement projections 35 and the spiral groove 23, the beam 30 is then embedded in the cylindrical body 20. Subsequently, the return spring 6 is inserted from the lower end side of the cylindrical body 20 and wound around an outer circumference of the beam 30. Further, the fastening member 34 is fitted to the beam 30 and the return spring 6 is sandwiched between the lower end surface 22A of the spiral cylinder section and the top surface 34A of the fastening member 34.

The beam 30 which is embedded in the cylindrical body 20 is inserted through a lower end opening of the front cylinder 10 positioning the cosmetic material retaining section 31 provided at an upper part of the beam 30 in order for the cosmetic material retaining section 31 to be housed in the cosmetic material storage hole 11. By pressing the fitting convex section 21 provided at an outer circumference of the cylindrical body 20 until the fitting convex section 21 fits into the fitting concavity section 15 provided at an inner circumference of the front cylinder 10, assembly is carried out so that the cylindrical body 20 is entirely housed in the front cylinder 10. Further, the O-ring 5 is put into the ring groove 18 provided at an outer circumference of the front cylinder 10 so as to complete the cartridge 1.

By fitting the cartridge 1 to the container body 2, the cosmetic container is completed. To be more precise, the cartridge 1 is housed in an upper part opening of the container body 2 from the lower end side, the synchronous engagement shaft 43 of the container body 2 is engaged with the synchronous engagement section 26 of the cylindrical body 20, and the fitting convex section 14 provided at an outer circumferential surface of the front cylinder 10 is put into the fitting concavity section 41 provided at an inner circumferential surface of the container body 2. Thus, the front cylinder 10 and the cylindrical body 20 are fitted to the container body 2 in such a manner that the front cylinder 10 can rotate to the container body 2, but the cylindrical body 20 cannot rotate to the container body 2. In this case, since positioning is easy when the synchronous engagement section 26 and the synchronous engagement shaft 43 are assembled, it is easy to fit the cartridge 1 to the container body 2.

A method of application of the cosmetic container according to this embodiment will subsequently be described.

When the stick type cosmetic material 4 is fed out from the cartridge 1, the cartridge 1 is first fitted into the container body 2. The cartridge 1 and the container body 2 are rotated in a direction of prescribed normal rotation holding the container body 2 and the exposed section 10A of the cartridge 1 which is exposed from the container body 2. In this case, since the beam 30 synchronously rotates with the front cylinder 10 due to the engagement with the front cylinder via the sliding mechanism (unrotatable engagement of the cosmetic material retaining section 31 and the cosmetic material storage hole 11 which are not circular), the beam 30 rotates to the cylindrical body 20 which is synchronously engaged with the container body 2. Thus, the plurality of engagement projections 35 provided at an outer circumference of the beam 30 are spirally engaged with the spiral groove 23 provided at an inner circumference of the spiral cylinder section 22 one after another, whereby the feeding mechanism functions. As a result, the beam 30 is fed out from the upper end side of the cylindrical body 20, and the stick type cosmetic material 4 retained by the cosmetic material retaining section 31 provided at an upper end of the beam 30 is fed out through the opening 12 provided at an upper end of the front cylinder 10.

Further, when the stick type cosmetic material 4 is pulled into the cartridge 1, if the cartridge 1 and the container body 2 are reversely rotated, each component of the cosmetic container will operate in a direction opposite to the above and the stick type cosmetic material 4 will retreat to the inside of the cartridge 1.

Or, in a state that the stick type cosmetic material 4 is left fed out, the cartridge 1 is removed from the container body 2. Thus, due to spring tension of the spring 6 which always urges the beam 30 downward, the beam 30 is brought back downward while rotating the beam 30, and the stick type cosmetic material 4 automatically retreats to the inside of the cartridge 1 (automatically returns). As described above, a user of the cosmetic container can bring back the stick type cosmetic material 4 merely by drawing out the cartridge 1 in a state that the stick type cosmetic material 4 is projected, whereby feed-down operation in the cosmetic container is facilitated and also it is possible to prevent the stick type cosmetic material 4 from breaking when the cartridge 1 is a single unit.

When such a cosmetic container is used, each component of this embodiment operates as follows.

Since the beam 30 and the front cylinder 10 are engaged via the sliding mechanism (unrotatable engagement of the cosmetic material retaining section 31 and the cosmetic material storage hole 11 which are not circular), the beam 30 does not rotate to the front cylinder 10 at the time of making a stroke. Thus, the stick type cosmetic material 4 retained by the cosmetic material retaining section 31 provided at a tip of the beam 30 is fed out through the opening 12 provided at a tip of the front cylinder 10 without rotating to the front cylinder 10. Therefore, there is no fear of the stick type cosmetic material 4 being damaged or breaking at the time of advance or retreat.

The O-ring 5 wound around the storage section 10B of the front cylinder 10 gives frictional resistance between the container body 2 and the front cylinder 10, and operation of the return spring 6 is controlled by the frictional resistance. More specifically, frictional force which arises between the O-ring 5 and the container body 2 is greater than the torque of the return spring 6 to reversely rotate the front cylinder 10 and the cylindrical body 20 and therefore the cartridge 1 and the container body 2 are retained in such a manner that they can be stationary, whereby the cartridge 1 is maintained at the rotary position. Further, frictional resistance of the O-ring 5 gives appropriate weight to the rotation of the cartridge 1, thereby giving a user of the cosmetic container the sensation of solidity in the operation. Further, due to the O-ring 5, it is possible to restrain the cartridge 1 from wobbling.

A feeding stroke of the beam 30 reaches the uppermost limit when spiral engagement of the engagement projections 35 of the beam 30 with the spiral groove 23 of the spiral cylinder section 22 is completed (when all the engagement projections 35 come out of the spiral groove 23) as shown in FIG. 4. Further, if the operation of rotating the cartridge 1 and the container body 2 is continued after reaching the feeding uppermost limit as described above, the cylindrical body 20 and the beam 30 will be raced. However, since the beam 30 is urged downward by the return spring 6 even in this case, a noise (click-clack) of contact of the engagement projection at the lowest row 35*a* with an upper end part of the spiral groove 23 arises, whereby a user who has listened to the noise can recognize that the feed-up has reached the limit. Therefore, the cosmetic container is not operated in such a manner that a strain is put on mechanisms in the cartridge and it is possible to prevent the mechanisms in the cartridge from being damaged (for example, the return spring 6 is compressed beyond a compression limit and damaged). Incidentally, if the cartridge 1 and the container body 2 are reversely rotated after reaching the feeding uppermost limit, the engagement projections 35 will return to the inside of the spiral groove 23 due to force of the return spring 6 and it will be possible to feed down the beam 30 by a reverse rotation.

Since the cylindrical body 20 is entirely housed in the front cylinder 10, an outer frame of the cartridge 1 is composed of the front cylinder 10 which is a single member. Thus, in the case that the cartridge 1 is removed from the container body 2 and left to be a single unit, the front cylinder 10 and the cylindrical body 20 cannot be rotated by the user with them being held. In other words, unless the cartridge 1 is fitted to the container body 2, operation of feeding out the stick type cosmetic material 4 from the cartridge 1 will not be carried out. Thus, it is possible to prevent the stick type cosmetic material 4 from being damaged or breaking which may occur resulting from feeding out the cosmetic material 4 by mistake when handling the cartridge 1 after detaching it from the container body 2.

Figure 5:
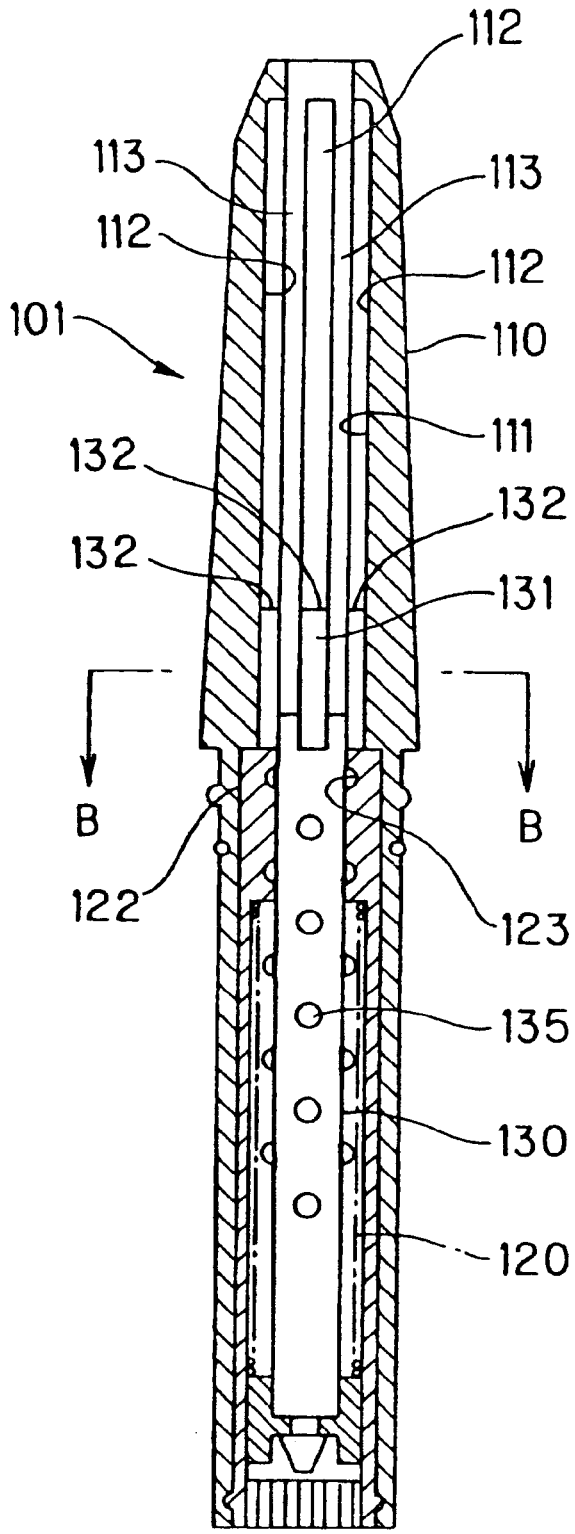
FIG. 5 is a sectional view showing a cartridge according to a second embodiment.
Figure 6:
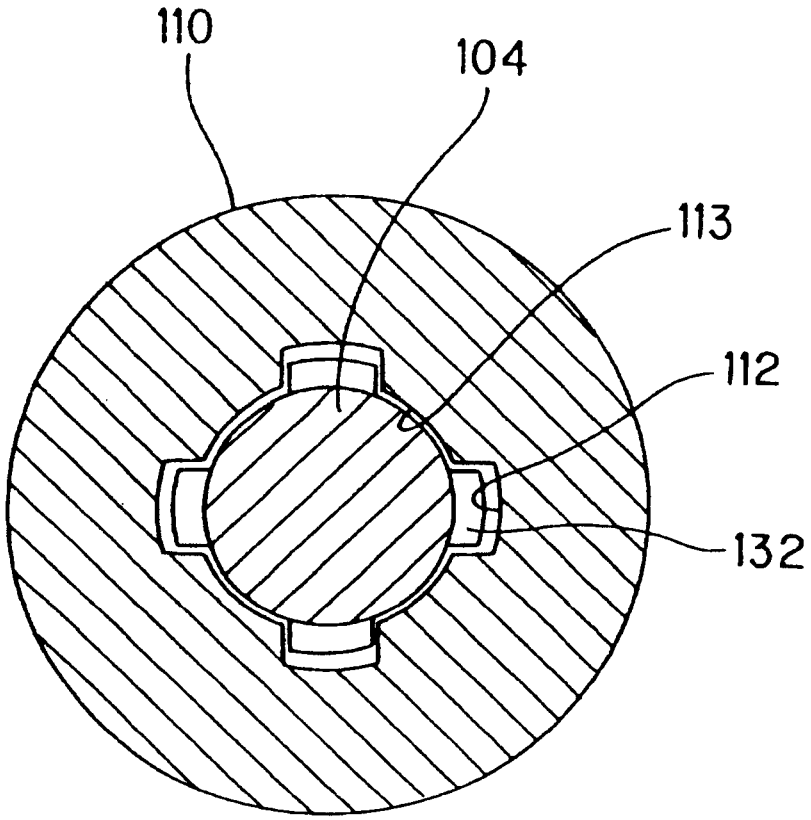
FIG. 6 is a sectional view taken along line B—B of FIG. 5 similarly.

FIG. 5 and FIG. 6 show a cartridge 101 according to a second embodiment of the present invention.

This embodiment differs from the first embodiment described above in that a cosmetic material retaining section 131 is composed of four pieces of claws 132 and a sliding mechanism is composed of these claws 132 and slide grooves 112 provided in a cosmetic material storage hole 111.

To be precise, the cosmetic material retaining section 131 of a beam 130 is composed of four pieces of claws 132 which are arranged at an outer circumference of an upper end part of the beam 130 at intervals of approximately 90 degrees. These claws 132 extend upward and retain a stick type cosmetic material 104 (omitted in FIG. 5) in such a manner that the claws 132 surround a lower end part of the stick type cosmetic material 104.

Further, correspondingly to these claws 132, the four slide grooves 112 extending in an axial direction are formed on an inner circumferential surface of the cosmetic material storage hole 111 at intervals of approximately 90 degrees. The four claws 132 are engaged with the corresponding slide grooves 112, respectively. Thus, each of the claws 132 is guided in an axial direction along the slide grooves 112. In other words, the four claws 132 and the slide grooves 112 function as the engagement section and the sliding section of the sliding mechanism, respectively, and the cosmetic material retaining section 131 (beam 130) makes a stroke in an axial direction without rotating to the front cylinder 10.

Further, four areas of an inner circumferential surface of the cosmetic material storage hole 111 which are sandwiched by each of the slide grooves 112 become slide surfaces 113. The stick type cosmetic material 104 retained by the cosmetic material retaining section 131 is supported among the four claws 132 from the side by these slide surfaces 113.

Further, in this embodiment, an outer diameter of the beam 130 is almost as large as an inner diameter of the cosmetic material storage hole 111. Engagement projections 135 provided at an outer circumference of the beam 130 are arranged in four columns below and in an axial direction of the claws 132. Thus, when the beam 130 is fed out to the side of the cosmetic material storage hole 111, the engagement projections 135 fed out to the side of the cosmetic material storage hole 111 are engaged in the slide grooves 112 one after another.

As described above, the engagement projections 135 operate as components of a feeding mechanism by spirally engaging with a spiral groove 123 and also operate as an engagement section of a sliding mechanism by engaging with the slide grooves 112. Therefore, the stroke of the beam 130 can be more stable. Further, even though a load in a direction of torsion is on the cartridge 101, a burden on the claws 132 can be eased by a portion equivalent to the support of the engagement projections 135, whereby the cartridge 101 which can carry the load in a direction of torsion can be constituted.

As described above, in the cosmetic container according to this embodiment, the stick type cosmetic material 104 is supported from the side by the slide surfaces 113 and also an overload is not on the claws 132. Thus, the stick type cosmetic material 104 can stably be fed out with little wobble, and the cosmetic container is suitable for the soft stick type cosmetic material 104 having a thin diameter which requires for example a thin and delicate outline, such as eyeliner, eyebrow, lip liner, or the like.

Figure 7:
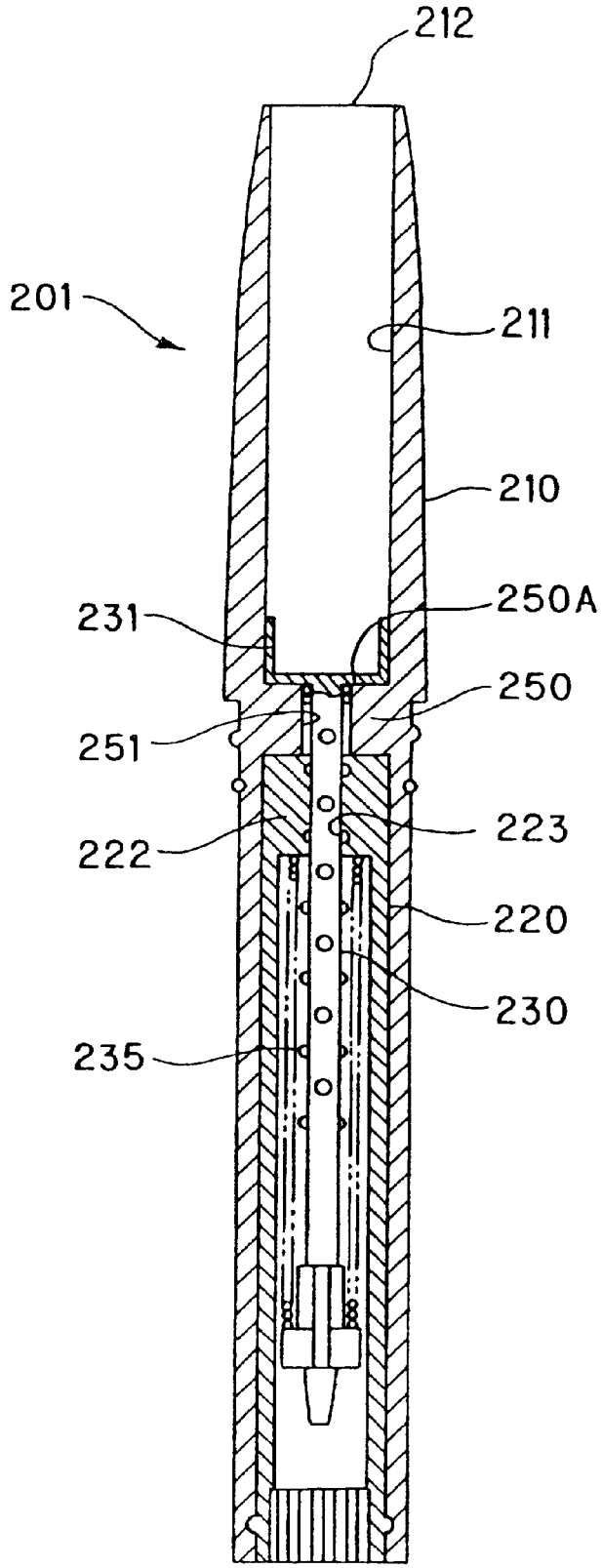
FIG. 7 is a sectional view showing a cartridge according to a third embodiment.

FIG. 7 shows a cartridge 201 according to a third embodiment of the present invention.

This embodiment differs from the first embodiment described above in that a small diameter section 250 having an inner diameter almost same as an outer diameter of a beam 230 is formed between a cosmetic material storage hole 211 of a front cylinder 210 and a spiral cylinder section 222.

Due to the constitution, at the lowermost limit of a stroke of the beam 230, a lower end of a cosmetic material retaining section 231 comes into contact with an upper end surface 250A of the small diameter section 250. Further, four slide grooves 251 are formed on an inner circumferential surface of the small diameter section 250 at locations which are corresponding to four straight lines of the beam 230 where engagement projections 235 are formed, and a part of the plurality of engagement projections 235 came out of a spiral groove 223 is supposed to be engaged with these slide grooves 251. Thus, the slide grooves 251 and the engagement projections 235 engaged with the slide grooves 251 operate as the sliding mechanism, and the beam 230 cannot rotate to the front cylinder 210, but can slide in an axial direction.

In the cartridge 201 according to this embodiment as described above, the slide grooves 251 are formed on an inner circumferential surface of the small diameter section 250 and it is not necessary to form a sliding section at the cosmetic material storage hole 211. Thus, it is possible to adopt as a stick type cosmetic material a type which is formed by filling up a liquid cosmetic raw material through an upper end opening 212 of the front cylinder 210. Further, in this case, since the small diameter section 250 is provided above a cylindrical body 220, the cosmetic raw material is hard to flow to the side of the cylindrical body 220, whereby productive efficiency of the cosmetic container can be enhanced. Further, it is not necessary to constitute the sliding mechanism by unrotatably engaging the cosmetic material storage hole 211 with the cosmetic material retaining section 231 which are not circular unlike the first embodiment described above, and therefore a cross section of the cosmetic material storage hole 211 can be a circle.

Figure 8:
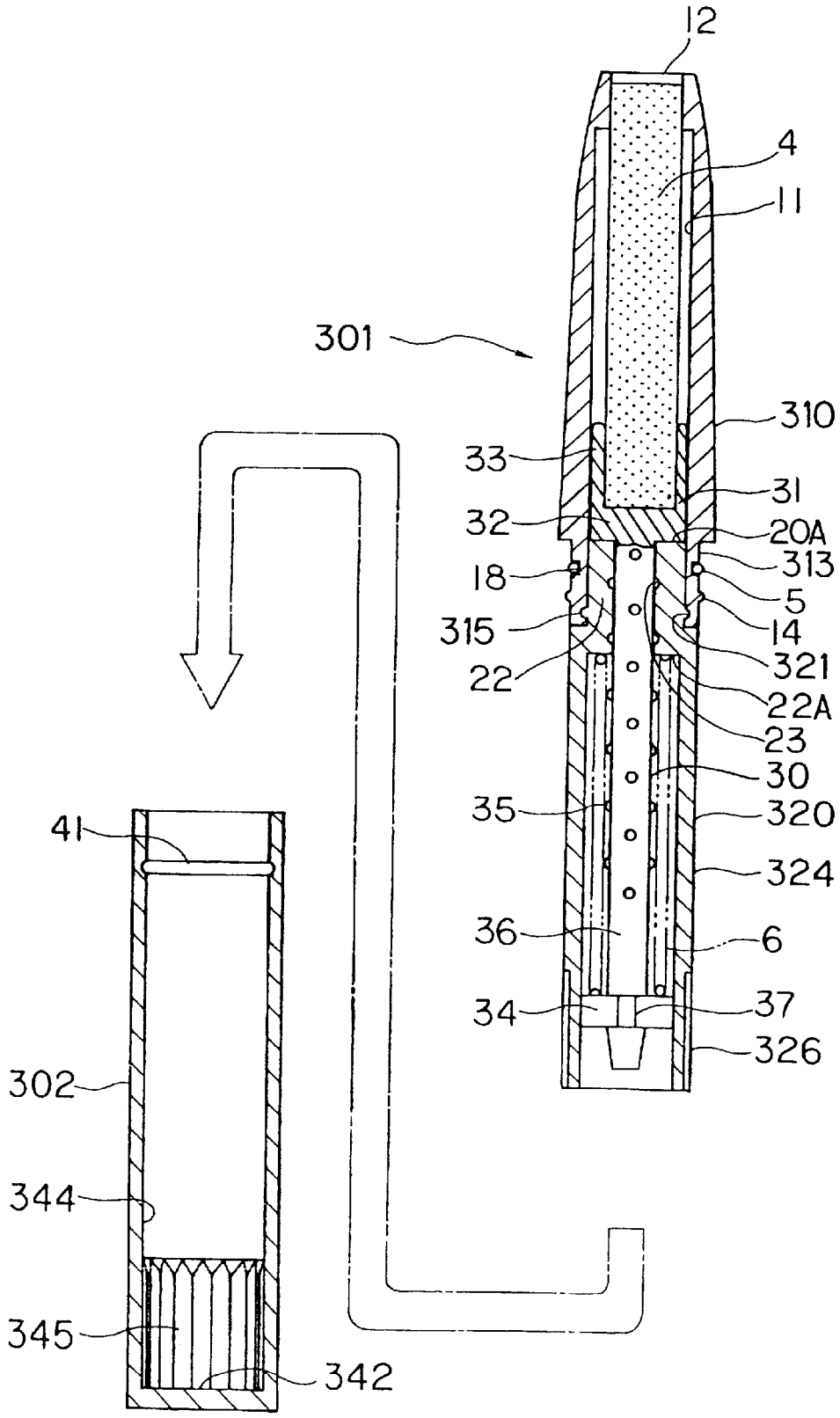
FIG. 8 is a sectional view showing a fourth embodiment.

FIG. 8 shows a cartridge according to a fourth embodiment of the present invention.

The cartridge 301 is housed in the container body 2 (refer to FIG. 1) according to an embodiment similar to the first embodiment described above and it constitutes a cosmetic container. Further, the cartridge 301 and the cartridge 1 (refer to FIG. 1) according to the first embodiment described above have fundamental constitution in common and the fourth embodiment differs from the first embodiment only in the constitution of a container body 302, a front cylinder 310, and a cylindrical body 320. Therefore, in FIG. 8, identical numerals are attached to the components having the same functions as those of the components according to the first embodiment, and also characteristic constitution of this embodiment is mainly shown.

The front cylinder 310 is a cylindrical member which constitutes a tip side of the cartridge 301. A base end side of the front cylinder 310 is a base end section 313 which has an outer diameter slightly smaller than that of the tip end side. When the cartridge 301 and the container body 302 are connected, the base end section 313 is housed in the container body 302 from an upper opening of the container body 302 together with the cylindrical body 320 in such a manner that the base end section 313 can freely be attached and detached. In this case, when the annular fitting convex section 14 provided at an outer circumference of the base end section 313 of the front cylinder 310 fits in the annular fitting concavity section 41 formed on an inner circumferential surface of the container body 302, the front cylinder 310 and the container body 302 are positioned so that they cannot move (come out) in an axial direction, but can freely rotate in a rotary direction along the fitting convex section 14 and the fitting concavity section 41.

An upper end side of the cylindrical body 320 is housed in the base end section 313 of the front cylinder 310, and the cylindrical body 320 and the front cylinder 310 constitute a cartridge body. In this case, a fitting convex section 321 formed at a prescribed location of an outer circumferential surface of the cylindrical body 320 fits in a fitting concavity section 315 formed on an inner circumferential surface of the front cylinder 310. Thus, the cylindrical body 320 is positioned so that it cannot move (come out) in an axial direction, but can freely rotate in a rotary direction to the front cylinder 310.

Further, a part extending from the lower end part 22A of the spiral cylinder section 22 to a lower end of the cylindrical body 320 is an extending section 324 which has an inner diameter larger than that of the spiral cylinder section 22.

A synchronous engagement section 326 which is composed of a plurality of male splines extending in an axial direction is formed on an outer circumferential surface of a lower end part of the cylindrical body 320. When the cartridge 301 is fitted to the container body 302, the synchronous engagement section 326 is connected by spline connection to a spline section 345 which is composed of male splines formed on an inner circumferential surface on the side of a bottom 342 of the container body 2. Thus, the cylindrical body 320 and the container body 302 are unrotatably connected. Therefore, it is arranged such that if the front cylinder 310 is rotated to the container body 302 when the cartridge 301 is fitted to the container body 302, the front cylinder 310 and the cylindrical body 320 will rotate.

The cartridge 301 is constituted in the manner described above and in assembling the cartridge 301, for example, a base end side of the beam 30 is first inserted in an opening on the tip side of the cylindrical body 320 in such a manner that the base end side of the beam 30 is spirally engaged with the opening so as to embed the beam 30 in the cylindrical body 320. The return spring 6 is then inserted from the base end side of the cylindrical body 30 and arranged at an outer circumference of the beam 30, a fastening member 34 is fitted to a fastening section 37 of the beam 30, and the return spring 6 is sandwiched between the lower end part 22A of the spiral cylinder section 22 and the fastening member 34. Further, the cylindrical body 320 in which the beam 30 is embedded is inserted from an opening on the side of a base end of the front cylinder 310 in order for the cosmetic material retaining section 31 to be housed in the cosmetic material storage hole 11 and when the fitting convex section 321 provided at an outer circumference of cylindrical body 320 is then pressed until the fitting convex section 321 fits in the fitting concavity section 315 provided at an inner circumference of the front cylinder 310, the cylindrical body 320 and the beam 30 are embedded in the front cylinder 310. Further, when the O-ring 5 is put in the ring groove 18 provided at an outer circumference of the front cylinder 310, the cartridge 301 is completed.

Further, when the cartridge 301 is fitted to the container body 302, the cartridge 301 is inserted from the side of the cylindrical body 320 into the upper opening of the container body 302. Thus, the spline section 345 of the container body 302 is engaged with the synchronous engagement section 326 provided at a base end of the cylindrical body 320, and the fitting convex section 14 provided on an outer circumferential surface of the front cylinder 310 fits in the fitting concavity section 41 provided on an inner circumferential surface of the container body 302. Thus, the front cylinder 310 is easily installed so that the front cylinder 310 can rotate to the container body 302, and the cylindrical body 320 is installed so that the cylindrical body 320 cannot rotate to the container body 302.

Next, operation will be described.

When the stick type cosmetic material 4 is fed out from the cartridge 301, the front cylinder 310 of the cartridge 301 is rotated in a direction of prescribed normal rotation to the container body 302. Then, the beam 30 engaged with the front cylinder 310 via the sliding mechanism (unrotatable engagement of the cosmetic material retaining section 31 with the cosmetic material storage hole 11 which are not circular) rotates synchronously with the front cylinder 310. On the other hand, since the cylindrical body 320 which is made a spline connection with the container body 302 does not rotate, the cylindrical body 320 and the beam 30 make relative rotations after all. Thus, the plurality of engagement projections 35 of the beam 30 are spirally engaged with the spiral groove 23 of the spiral cylinder section 22 one after another and therefore the beam 30 is fed out of the tip side of the cylindrical body 320.

Figure 9:
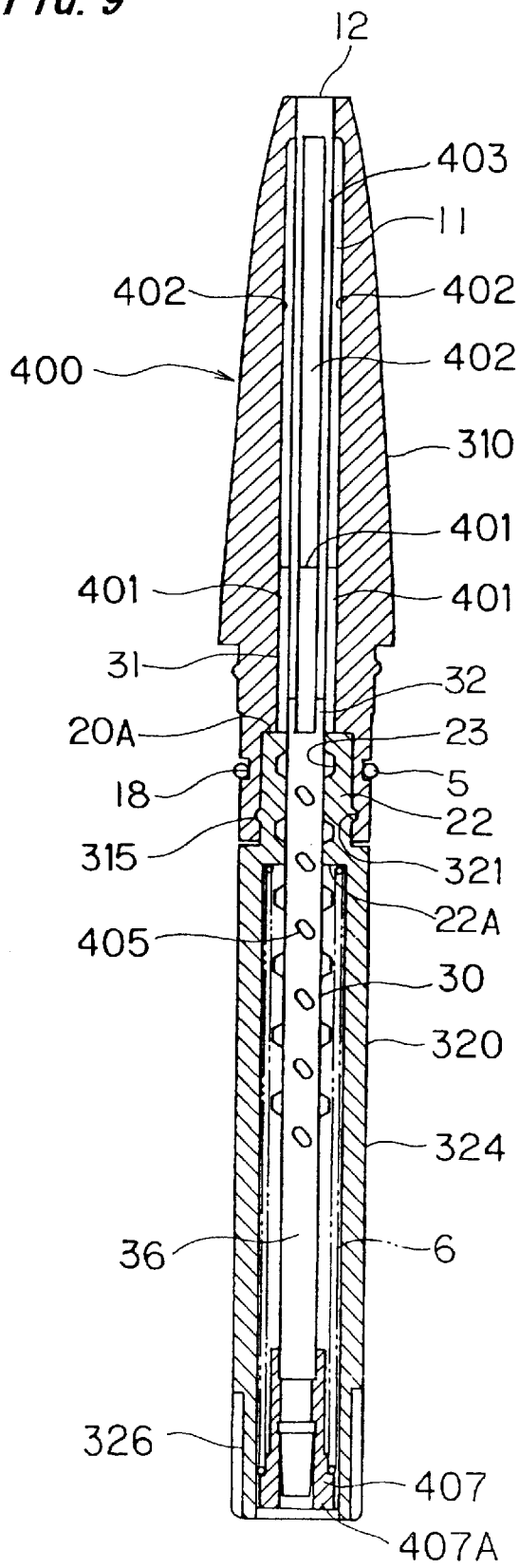
FIG. 9 is a sectional view of a cartridge showing a fifth embodiment.

FIG. 9 shows a cartridge 400 according to a fifth embodiment of the present invention.

The cartridge 400 is housed in the container body 302 (refer to FIG. 8) according to an embodiment similar to the fourth embodiment described above and constitutes the cosmetic container. Further, the cartridge 400 and the cartridge 301 (refer to FIG. 8) according to the fourth embodiment described above have fundamental constitution in common and these cartridges differ from each other only in the constitution of the beam 30 and the cosmetic material storage hole 11 of the front cylinder 310. Therefore, in FIG. 9, identical numerals are attached to the components having the same functions as those of the components according to the fourth embodiment, and also characteristic constitution of this embodiment is mainly shown.

As shown in the drawing, the cosmetic material retaining section 31 of the beam 30 is composed of the base section 32 and four pieces of claws 401 which are provided upward in a standing position from the side of the base section 32. These claws 401 are arranged at intervals of approximately 90 degrees, and the stick type cosmetic material is retained almost coaxially with the front cylinder 310 in such a manner that the stick type cosmetic material is surrounded by these claws 401.

Correspondingly to these claws 401, four engagement grooves 402 extending in an axial direction are formed on an inner circumferential surface of the cosmetic material storage hole 11 at intervals of approximately 90 degrees. The four claws 401 are engaged with the corresponding engagement grooves 402, respectively, and the cosmetic material retaining section 31 is guided in an axial direction along the engagement grooves 402. Thus, the cosmetic material retaining section 31 makes a stroke in an axial direction without rotating to the front cylinder 310. In other words, in this embodiment, the sliding mechanism is composed of the engagement grooves 402 and the claws 401, and the engagement grooves 402 serve as a sliding section of the sliding mechanism and the claws 401 serve as an engagement section of the sliding mechanism.

Incidentally, it is preferable that a width of projection in a direction of the cartridge's diameter of a part of the claws 401 which retains the stick type cosmetic material is equal to or smaller than a width of projection in a direction of the cartridge's diameter of the base section 32 of the claws 401 as shown in the drawing. Thus, a large load will never be on the part of the claws 401 which retains the stick type cosmetic material. As a result, it is possible to prevent the stick type cosmetic material from being damaged or coming off the claws 401.

Further, four areas of an inner circumferential surface of the cosmetic material storage hole 11 which are sandwiched by each of the engagement grooves 402 become slide surfaces 403. The stick type cosmetic material 4 retained by the cosmetic material retaining section 31 is sufficiently supported between the claws 401 from the side by these slide surfaces 403.

Figure 10:
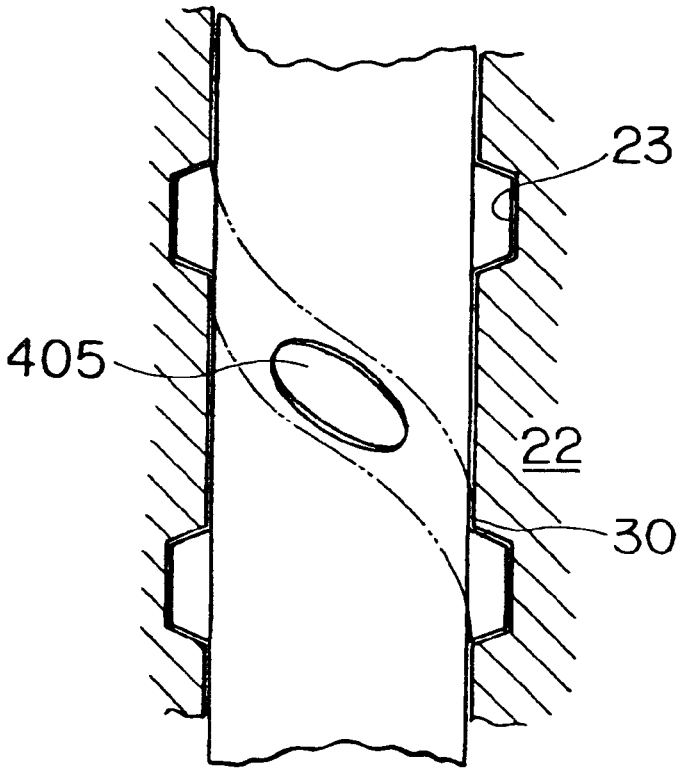
FIG. 10 is a front view showing a part of a beam similarly.

A plurality of engagement projections 405 are formed on four straight lines of the beam 30 which are below the respective four claws 401 and extend in an axial direction. These engagement projections 405 are along a spiral track (a track which can be spirally engaged with the spiral groove 23) as a whole as shown in FIG. 10.

Further, it is set such that a shape of an inner circumferential surface of the cosmetic material storage hole 11 is almost same as that of an outer diameter of the respective engagement projections 405 of the beam 30. Further, the engagement projections 405 are spread in a direction of width so that they have almost same width as that of the engagement grooves 402, and the engagement projections 405 are elliptical so as to be along the spiral track described above.

Figure 11:
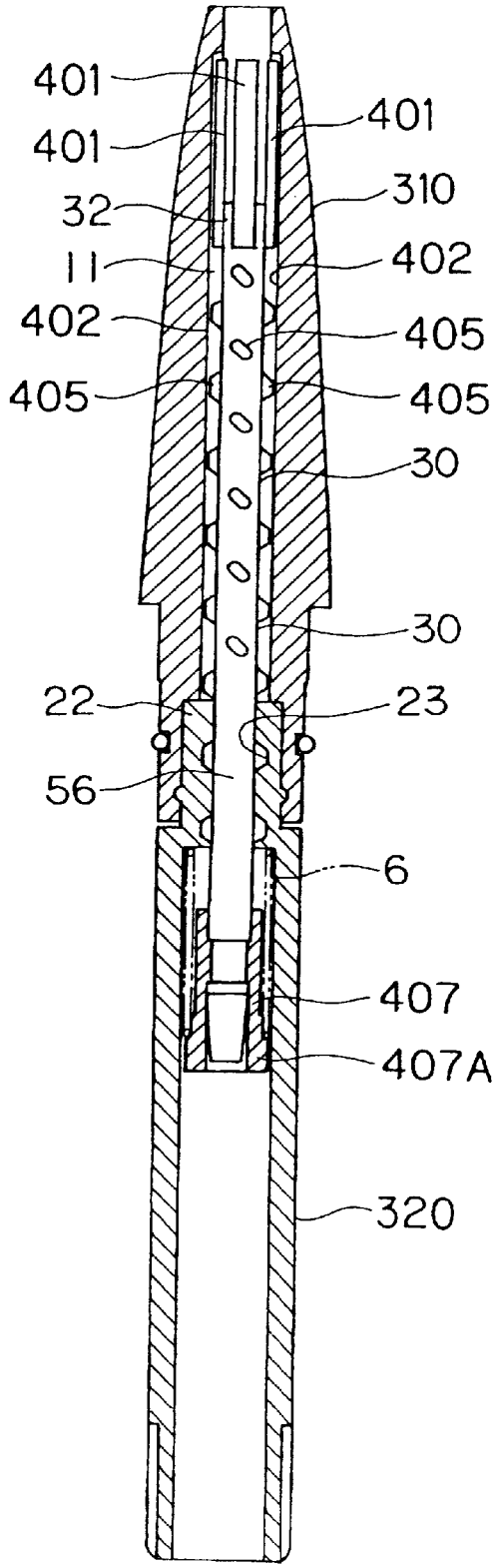
FIG. 11 is a sectional view of a cartridge showing a state that the beam makes a stroke similarly.

Due to the constitution described above, as shown in FIG. 11, when the beam 30 makes a stroke to the side of the cosmetic material storage hole 11, the engagement projections 405 are successively engaged in a rotary direction with the corresponding engagement grooves 402 leaving no space between them. In other words, when fed out in the cosmetic material storage hole 11, the engagement projections 405 operate as an engagement section of the sliding mechanism.

Thus, in the cartridge 400 according to this embodiment, the stroke of the beam 30 can be more stable, and when a load in a direction of torsion is on the cartridge 400, the beam 30 is supported also by the engagement projections 405. Therefore, it is possible to constitute the cosmetic container which can bear a load in a direction of torsion, and also a burden on the claws 401 can be eased. Thus, the cartridge 400 according to this embodiment has a diameter thinner than that of the cartridge 301 according to the fourth embodiment, and the cartridge 400 is more suitable for the soft stick type cosmetic material 4 than the cartridge 301 is. Further, it will be sufficient if a width of the respective claws 401 is widen as occasion demands in order to retain the stick type cosmetic material 4 more stably.

Incidentally, in this embodiment, a C-ring 407 is fastened to a base end section of the beam 30 as a spring seat member. It is arranged such that the return spring 6 is installed between an upward step section of a flange section 407A of the C-ring 407 and the lower end part 22A of the spiral cylinder section 22.

Figure 12:
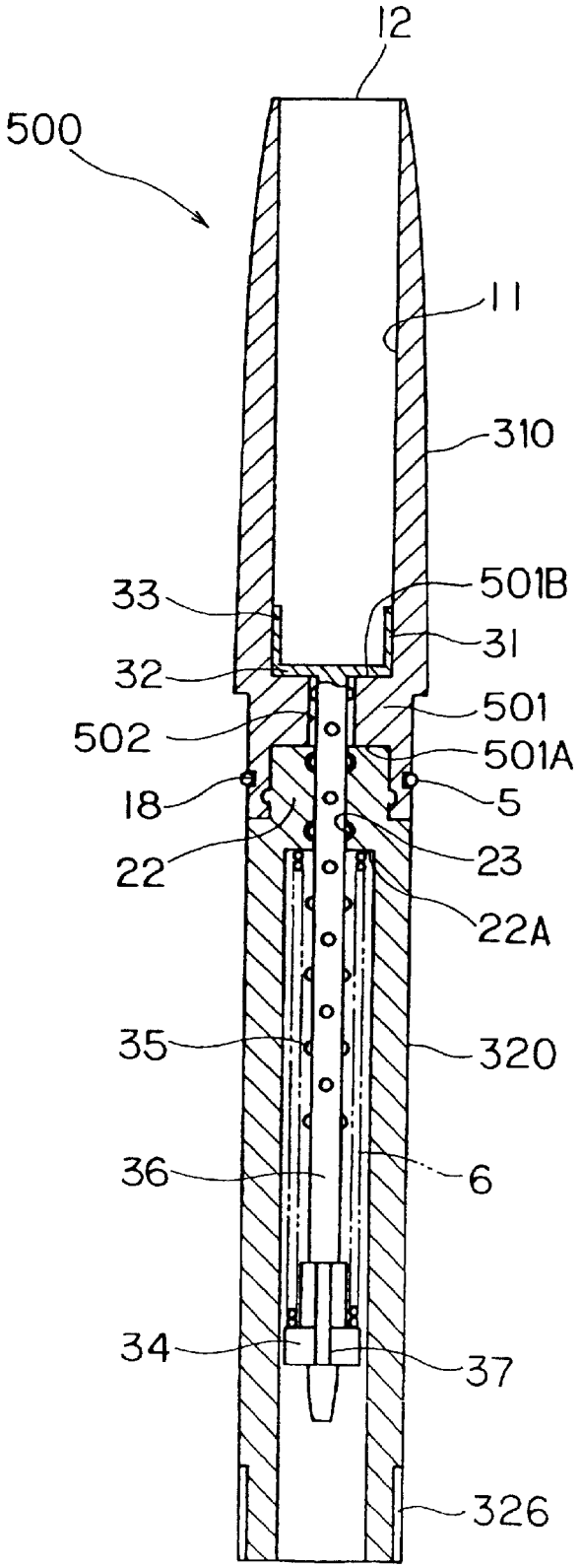
FIG. 12 is a sectional view of a cartridge showing a sixth embodiment.

FIG. 12 shows a cartridge 500 according to a sixth embodiment of the present invention.

Also, the cartridge 500 is housed in the container body 302 according to an embodiment similar to the embodiment shown in FIG. 8 and it constitutes the cosmetic container. The cartridge 500 differs from the cartridge 301 (refer to FIG. 8) according to the fourth embodiment described above only in the constitution of the front cylinder 310. Therefore, in FIG. 12, identical numerals are attached to the components having the similar functions as those of the components according to the fourth embodiment, and in the following description, the constitution which differs from that of the fourth embodiment described above is mainly shown.

In this embodiment, a small diameter section 501 which has an inner diameter almost same as an outer diameter of the beam 30 is formed on this side of the base end section of the front cylinder 310, and the base section 32 of the cosmetic material retaining section 31 comes into contact with an upper end surface 501B of the small diameter section 501 at the lowermost limit of a stroke of the beam 30.

Further, four slide grooves 502 are formed on an inner circumferential surface of the small diameter section 501 at locations which are corresponding to four straight lines of the beam 30 where the engagement projections 35 are formed, and a part of the plurality of engagement projections 35 is supposed to be engaged with these slide grooves 502. Thus, the slide grooves 502 and the engagement projections 35 which are engaged with the slide grooves 502 operate as the sliding mechanism, and they guide the beam 30 in an axial direction so that the beam 30 will not rotate to the front cylinder 310.

Further, according to this embodiment, since the cosmetic material storage hole 11 is partitioned by the small diameter section 501, when a liquid cosmetic raw material is filled up in the cosmetic material storage hole 11 so as to form the stick type cosmetic material 4, the cosmetic raw material will not easily flow to the side of the cylindrical body 320. Therefore, productive efficiency of the cosmetic container can be enhanced.

What is claimed is:

1. A cartridge for a cosmetic container which is fitted to a container body in such a manner that the cartridge can freely be attached and detached, houses and retains a stick type cosmetic material therein, and moves the stick type cosmetic material forward or backward through an upper end opening by rotations of the cartridge and the container body, the cartridge comprising:

a front cylinder which is provided with the upper end opening; and a cylindrical body at least a part of which is rotatably and unslidably housed in the front cylinder, wherein a cartridge body is composed of the front cylinder and the cylindrical body, a beam is housed in the cartridge body, and a cosmetic material retaining section for retaining the stick type cosmetic material is formed on an upper end side of the beam, the cartridge further comprising:

a sliding mechanism for unrotatably and slidably retaining the beam in the front cylinder;

a feeding mechanism for feeding out the beam in an axial direction by relative rotations of the beam and the cylindrical body; and a spring which always urges the beam backward, and synchronous engagement means which are synchronously engaged with the container body are provided at a lower end part of the cylindrical body.

2. A cartridge for a cosmetic container according to claim 1, wherein the cylindrical body is entirely housed in the front cylinder.

3. A cartridge for a cosmetic container according to claim 1, wherein the cylindrical body is housed on a base end side of the front cylinder.

4. A cartridge for a cosmetic container according to claim 1, wherein a lower end part of the cylindrical body and a lower end part of the front cylinder are of almost same height, the synchronous engagement means are composed of spline grooves formed on an inner circumferential surface on a lower end side of the cylindrical body, and a synchronous engagement shaft provided at a bottom of the container body is made a spline connection with the spline grooves, whereby the cylindrical body and the container body are synchronously engaged.

5. A cartridge for a cosmetic container according to claim 4, wherein a non-projection section in which the spiral section does not exist is formed on a base end side of the beam, and also a stroke limit of the beam is defined when the beam makes a stroke to a position where the non-projection section faces the spiral groove.

6. A cartridge for a cosmetic container according to claim 1, wherein the feeding mechanism is composed of a spiral section formed at an outer circumference of the beam and a spiral groove which is formed on an inner circumferential surface of the cylindrical body and with which a part of the spiral section is spirally engaged.

7. A cartridge for a cosmetic container according to claim 1, wherein the sliding mechanism is composed of an engagement section formed at an outer circumference of the beam and a sliding section which is formed at an inner circumference of the front cylinder and engaged with the engagement section.

8. A cartridge for a cosmetic container according to claim 7, wherein the engagement section of the sliding mechanism is a plurality of claws for retaining the stick type cosmetic material in such a manner that the stick type cosmetic material is surrounded by these claws, and also the stick type cosmetic material is supported between these claws from a side by an inner circumferential surface of the front cylinder.

9. A cartridge for a cosmetic container according to claim 7, wherein a small diameter section is formed at the front cylinder so that the small diameter section is positioned right above the cylindrical body, and also the sliding section is formed on an inner circumferential surface of the small diameter section.

10. A cartridge for a cosmetic container according to claim 7, wherein the spiral section is a plurality of engagement projections arranged below the engagement section and on straight lines which extend in an axial direction and also the spiral section becomes an engagement section which is engaged with a sliding section formed on an upper part side of the front cylinder when fed out to a an upper part side of the front cylinder.

11. A cartridge for a cosmetic container according to claim 7, wherein the engagement section of the sliding mechanism is formed at an outer circumference of the cosmetic material retaining section.

12. A cartridge for a cosmetic container according to claim 11, wherein the engagement section of the sliding mechanism is formed below the cosmetic material retaining section and also the sliding section is formed on an inner circumferential surface of a small diameter section formed on a base end side of the front cylinder.

13. A cartridge for a cosmetic container according to claim 7, wherein a plurality of engagement projections formed at an outer circumference of the beam are arranged on straight lines extending in an axial direction and also when fed out to a sliding section side of the sliding mechanism, these engagement projections become an engagement section which is engaged with the sliding section.

14. A cartridge for a cosmetic container according to claim 1, wherein the spring is a coil spring wound around an outer circumference of the beam, an upper end of the coil spring is in contact with a downward step section formed at the cylindrical body, and a lower end of the coil spring is in contact with an upward step section provided at the beam.

15. A cartridge for a cosmetic container according to claim 1, wherein an O-ring is provided between an outer circumference of the front cylinder and an inner circumference of the container body and it is arranged such that frictional force which arises resulting from the O-ring is greater than resiliency of the spring to cause a reverse rotation of the front cylinder and the container body.

16. A cosmetic container composed of a cartridge which houses and retains a stick type cosmetic material therein and moves the stick type cosmetic material forward and backward through an upper end opening by a rotation together with a container body and the container body to which the cartridge is attachably and detachably fitted, wherein the cartridge comprising:

a front cylinder having the upper end opening;

a cylindrical body which is entirely housed in the front cylinder in such a manner that the cylindrical body can rotate, but cannot slide;

a beam which is housed in the front cylinder and the cylindrical body;

a cosmetic material retaining section for retaining the stick type cosmetic material on an upper end side of the beam;

a sliding mechanism for retaining the beam in the front cylinder in such a manner that the beam cannot rotate, but can slide;

a feeding mechanism for feeding out the beam in an axial direction by rotations of the beam and the cylindrical body;

a spring for always urging the beam backward; and synchronous engagement means which are provided at a lower end part of the cylindrical body and are synchronously engaged with the container body, and when the cartridge is housed in the container body, the front cylinder can rotate to the container body and the feeding mechanism is unrotatably connected with the container body via the synchronous engagement means which are provided at the lower end part of the cylindrical body and are synchronously engaged with the container body.

17. A cosmetic container composed of a cartridge which stores and retains a stick type cosmetic material therein and moves the stick type cosmetic material forward and backward through an upper end opening by a rotation together with a container body and the container body to which the cartridge is attachably and detachably fitted, wherein the cartridge comprising:

a front cylinder having the upper end opening;

a cylindrical body which is rotatably fitted to a base end part of the front cylinder;

a beam which is housed in the front cylinder and the cylindrical body;

a cosmetic material retaining section which retains the stick type cosmetic material on an upper end side of the beam;

a sliding mechanism which retains the beam in the front cylinder in such a manner that the beam cannot rotate, but can slide;

a feeding mechanism which feeds out the beam in an axial direction by rotations of the beam and the cylindrical body;

a spring which always urges the beam backward; and synchronous engagement means which are provided at a lower end part of the cylindrical body and are synchronously engaged with the container body, and when the cartridge is stored in the container body, the front cylinder is rotatable to the container body and the feeding mechanism is unrotatably connected with the container body via the synchronous engagement means which are provided at the lower end part of the cylindrical body and are synchronously engaged with the container body.

* * * * *